US011434669B2

(12) United States Patent
Hitomi

(10) Patent No.: US 11,434,669 B2
(45) Date of Patent: Sep. 6, 2022

(54) VEHICLE SLIDE DOOR APPARATUS

(71) Applicant: TOYOTA JIDOSHA KABUSHIKI KAISHA, Toyota (JP)

(72) Inventor: Yoshinori Hitomi, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 664 days.

(21) Appl. No.: 16/192,954

(22) Filed: Nov. 16, 2018

(65) Prior Publication Data

US 2019/0169881 A1 Jun. 6, 2019

(30) Foreign Application Priority Data

Dec. 1, 2017 (JP) ..... JP2017-231921

(51) Int. Cl.
*E05B 77/26* (2014.01)
*E05B 83/40* (2014.01)
*E05B 77/04* (2014.01)

(52) U.S. Cl.
CPC ..... *E05B 77/04* (2013.01); *E05B 77/26* (2013.01); *E05B 83/40* (2013.01); *E05Y 2900/531* (2013.01); *Y10S 292/37* (2013.01); *Y10S 292/63* (2013.01); *Y10T 292/1047* (2015.04)

(58) Field of Classification Search
CPC ... Y10T 292/1047; E05B 77/04; E05B 77/26; E05B 77/265; E05B 83/40; Y10S 292/37; Y10S 292/63
See application file for complete search history.

(56) References Cited

U.S. PATENT DOCUMENTS 3,923,329 A * 12/1975 Torii ..... E05B 77/265 292/216
4,487,441 A 12/1984 Miyamoto et al.
4,900,074 A * 2/1990 Kleefeldt ..... E05B 77/265 292/216
5,092,638 A * 3/1992 Mizuki ..... E05B 77/265 292/216
5,702,136 A * 12/1997 Funk ..... E05B 77/265 292/216

(Continued)

FOREIGN PATENT DOCUMENTS

JP S58-054171 A 3/1983
JP 2001-182404 A 7/2001

(Continued)

*Primary Examiner* — Carlos Lugo
(74) *Attorney, Agent, or Firm* — Oliff PLC

(57) ABSTRACT

A vehicle slide door apparatus includes: a bracket fixed in a slide door; a lever operation mechanism supported on the bracket, and causing a release lever connected to a door lock part to perform an opening operation in accordance with manipulation of an inner handle in an opening direction, the door lock part bringing the slide door into an openable state upon the opening operation of the release lever; a child protect lever movably supported on the bracket, and making, by its movement to one side, manipulation force of the inner handle not be transmitted to the release lever; and a slider supported, in the bracket, on a side of an outer panel of the slide door slidably to a vehicle compartment interior side, and when being pushed to the vehicle compartment interior side, moving the child protect lever to the one side.

3 Claims, 7 Drawing Sheets

(56) References Cited

U.S. PATENT DOCUMENTS

| | | | | |
|---|---|---|---|---|
| 5,738,394 | A * | 4/1998 | Arabia, Jr. | E05B 77/265 292/216 |
| 5,762,383 | A * | 6/1998 | Gomi | E05B 77/26 292/216 |
| 6,168,215 | B1 * | 1/2001 | Kodama | E05B 81/06 292/201 |
| 6,199,923 | B1 * | 3/2001 | Rice | E05B 77/26 292/216 |
| 6,554,329 | B1 * | 4/2003 | DeBlock | E05B 83/36 292/216 |
| 6,722,714 | B2 * | 4/2004 | Ooe | E05B 81/06 292/216 |
| 7,380,845 | B2 * | 6/2008 | Suzumura | E05B 77/26 292/216 |
| 7,540,541 | B2 * | 6/2009 | Yoneyama | E05B 81/20 292/201 |
| 7,625,020 | B2 * | 12/2009 | Fujimatsu | E05B 83/36 292/201 |
| 8,684,425 | B2 * | 4/2014 | Nagaoka | E05B 81/06 292/336.3 |
| 8,740,264 | B2 * | 6/2014 | Akizuki | E05B 81/16 292/201 |
| 9,784,020 | B2 * | 10/2017 | Kwon | E05B 83/24 |
| 10,584,521 | B2 * | 3/2020 | Nieto Avila | B62D 25/12 |
| 10,597,907 | B2 * | 3/2020 | Yamashita | E05B 81/64 |

FOREIGN PATENT DOCUMENTS

| | | | |
|---|---|---|---|
| JP | 2015-031142 | A | 2/2015 |
| KR | 20170019540 | A | 2/2017 |

* cited by examiner

VEHICLE SLIDE DOOR APPARATUS

CROSS REFERENCE TO RELATED APPLICATION

The entire disclosure of Japanese Patent Application No. 2017-231921 filed on Dec. 1, 2017, including the specification, claims, drawings, and abstract, is incorporated herein by reference in its entirety.

BACKGROUND

Technical Field

The present disclosure relates to a vehicle slide door apparatus including a bracket, and a lever operation mechanism and a child protect lever which are supported on the bracket.

Related Art

JP 2015-031142 A discloses a configuration, in a vehicle including a slide door, in which a door lock part as a latch unit is connected to a remote controller of the slide door. With this configuration, when an inner handle is manipulated in the opening direction, the inner handle inputs manipulation force for release to the door lock part via a mechanism part of the remote controller.

In view of the protection of an occupant, it is important for the slide door not to open due to load exerted thereon upon vehicle side impact. Meanwhile, regulations regarding vehicle side impact are becoming strict in recent years. With the configuration disclosed in JP 2015-031142 A, if higher load is exerted on the slide door due to such strict regulations, a portion, of the inner handle, protruding outward in the vehicle widthwise direction may be pushed to the vehicle compartment interior side by an outer panel of the door, thereby causing it to be forcibly rotated, which may result in opening of the door.

An advantage of the present disclosure is that, in a vehicle slide door apparatus, a slide door is prohibited from opening when the slide door is pushed to the vehicle compartment interior side upon vehicle side impact.

SUMMARY

A vehicle slide door apparatus of the present disclosure is a vehicle slide door apparatus including: a bracket fixed in a slide door; a lever operation mechanism supported on the bracket, and causing a release lever connected to a door lock part to perform opening operation in accordance with manipulation of an inner handle in an opening direction, the door lock part holding the slide door in a closed state when the release lever does not perform the opening operation, the door lock part bringing the slide door into an openable state upon the opening operation of the release lever; a child protect lever movably supported on the bracket, and making, by its movement to one side, manipulation force of the inner handle not be transmitted to the release lever; and a slider supported, in the bracket, on a side of an outer panel of the slide door so as to be slidable to a vehicle compartment interior side which is an opposite side relative to the outer panel, and when being pushed to the vehicle compartment interior side, moving the child protect lever to the one side.

According to the aforementioned configuration, upon vehicle side impact, the slider can be moved to the vehicle compartment interior side when the slide door is pushed to the vehicle compartment interior side. Thereby, since the child protect lever can be moved in one direction so as to allow manipulation force of the inner handle not to be transmitted to the release lever, the slide door can be prohibited from opening.

In the vehicle slide door apparatus of the present disclosure, the child protect lever may be supported, in the bracket, swingingly movably around an axis along a vehicle widthwise direction, the slider may be supported, in the bracket, movably in the vehicle widthwise direction, and have an inclined face inclined relative to the vehicle widthwise direction, the inclined face facing the child protect lever, and when the slider is pushed to the vehicle compartment interior side, the slider may push the child protect lever with the inclined face so as to move the child protect lever to the one side.

According to the aforementioned configuration, upon vehicle side impact, the child protect lever can be more smoothly moved in the one direction by the movement of the slider.

According to the vehicle slide door apparatus of the present disclosure, upon vehicle side impact, the slide door can be prohibited from opening when the slide door is pushed to the vehicle compartment interior side.

BRIEF DESCRIPTION OF THE DRAWINGS

Embodiments of the present disclosure will be described based on the following figures, wherein.

DESCRIPTION OF EXEMPLARY EMBODIMENTS

Figure 1:
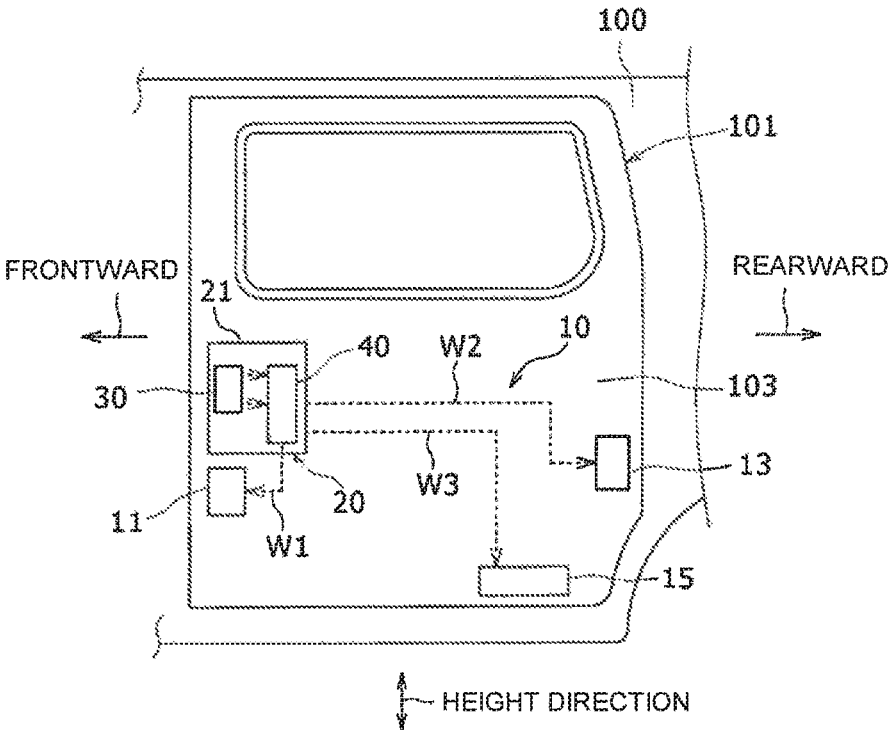
FIG. 1 is a configurational diagram of a vehicle slide door apparatus of an embodiment according to the present disclosure.

Hereafter, embodiments of the present disclosure will be described using the drawings. Shapes, materials and numbers described below are exemplary for explanation and they may be appropriately modified in accordance with specifications and the like of a vehicle including a slide door apparatus. Hereafter, in all the drawings, the equivalent elements are described with the same reference numerals. Moreover, in the description in the text, previously mentioned reference numerals are used as needed.

FIG. 1 is a configurational diagram of a vehicle slide door apparatus 10 of an embodiment. The vehicle slide door apparatus 10 is applied to a vehicle 100 including a slide door 101. The slide door 101 is movably supported in the front/rear direction at a lateral part of the vehicle body. By the slide door 101 moving in the front/rear direction, an opening for boarding is opened and closed. The slide door 101 is formed by joining an outer panel 102 (FIG. 3) outward in the vehicle widthwise direction (front/back direction of the view plane of FIG. 1) and an inner panel 103 inward in the vehicle widthwise direction, and inside, has a space in which devices such as a remote controller 20 and the like of the vehicle slide door apparatus 10 are disposed.

The vehicle slide door apparatus 10 includes the remote controller 20, a front lock part 11, a rear lock part 13 and a full open lock part 15 which are disposed in the slide door 101. Each of the front lock part 11 and a rear lock part 13 corresponds to a door lock part.

As mentioned later, the remote controller 20 is connected to the front lock part 11, the rear lock part 13 and the full open lock part 15 with cables W1, W2 and W3, and manipulates the front, rear and full open lock parts 11, 13 and 15.

The front lock part 11 is disposed on the front end side in the slide door 101. The rear lock part 13 is disposed on the rear end side in the slide door 101. The full open lock part 15 is disposed on the lower end side in the slide door 101.

With the slide door 101 closed, the front lock part 11 engages with a front striker (not shown) fixed to the front edge of the opening for boarding. Meanwhile, the rear lock part 13 engages with a rear striker (not shown) fixed to the rear edge of the opening for boarding. In this state, the full open lock part 15 does not engage with a lower striker (not shown) fixed to the rear lower edge of the opening for boarding.

The front and rear lock parts 11 and 13 receive power from the remote controller 20 to release their engagements with the front and rear strikers, and thereby bring the slide door 101 into the openable state.

The full open lock part 15 receives power from the remote controller 20 to release the engagement with the striker, and thereby bring the slide door 101 into the closable state in full open.

Figure 2:
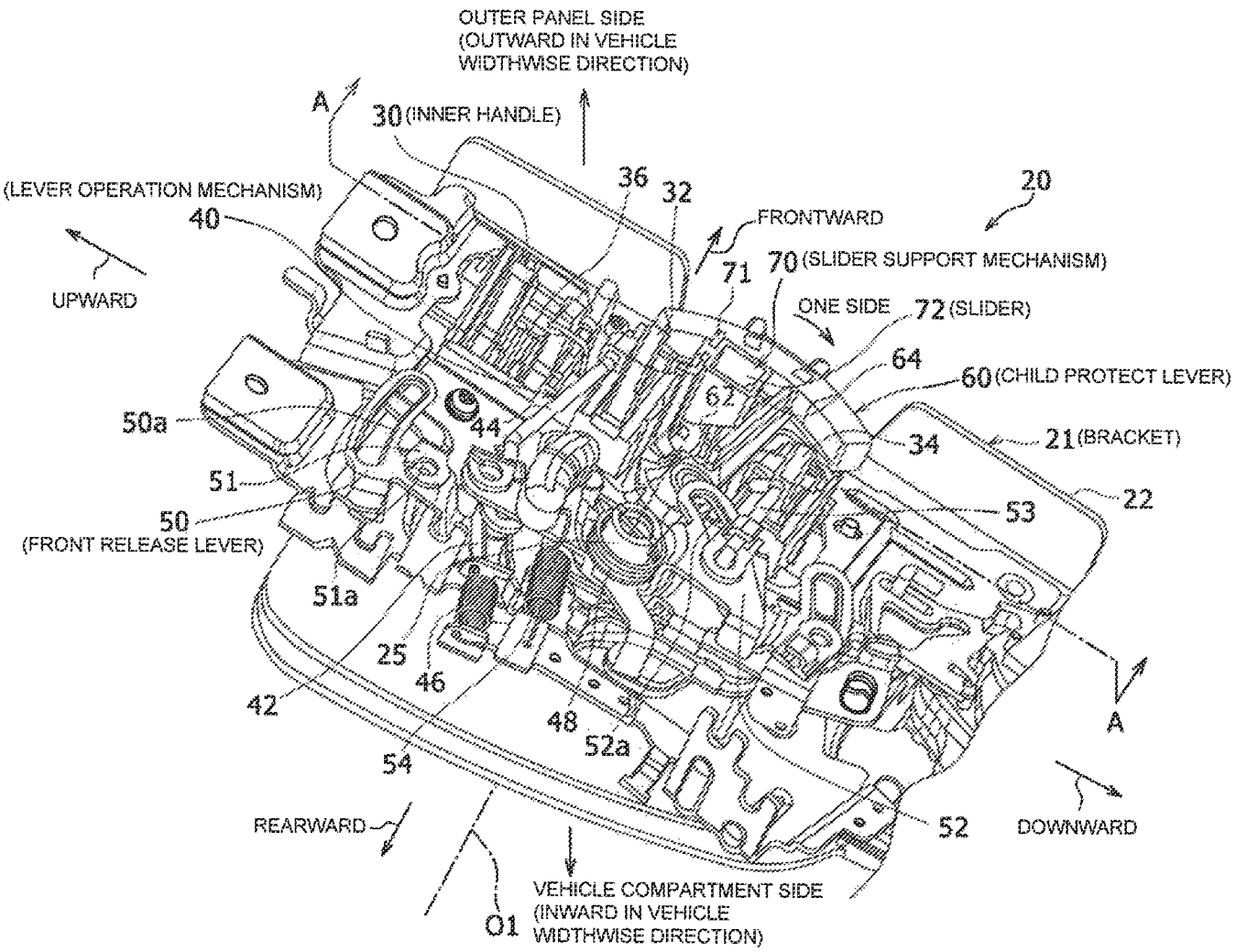
FIG. 2 is a perspective view showing a remote controller constituting the vehicle slide door apparatus shown in FIG. 1, with a part of the remote controller omitted.

The remote controller 20 includes a bracket 21, an inner handle 30, a lever operation mechanism 40, a child protect lever 60 (FIG. 2), and a slider support mechanism 70 (FIG. 2).

Figure 3:
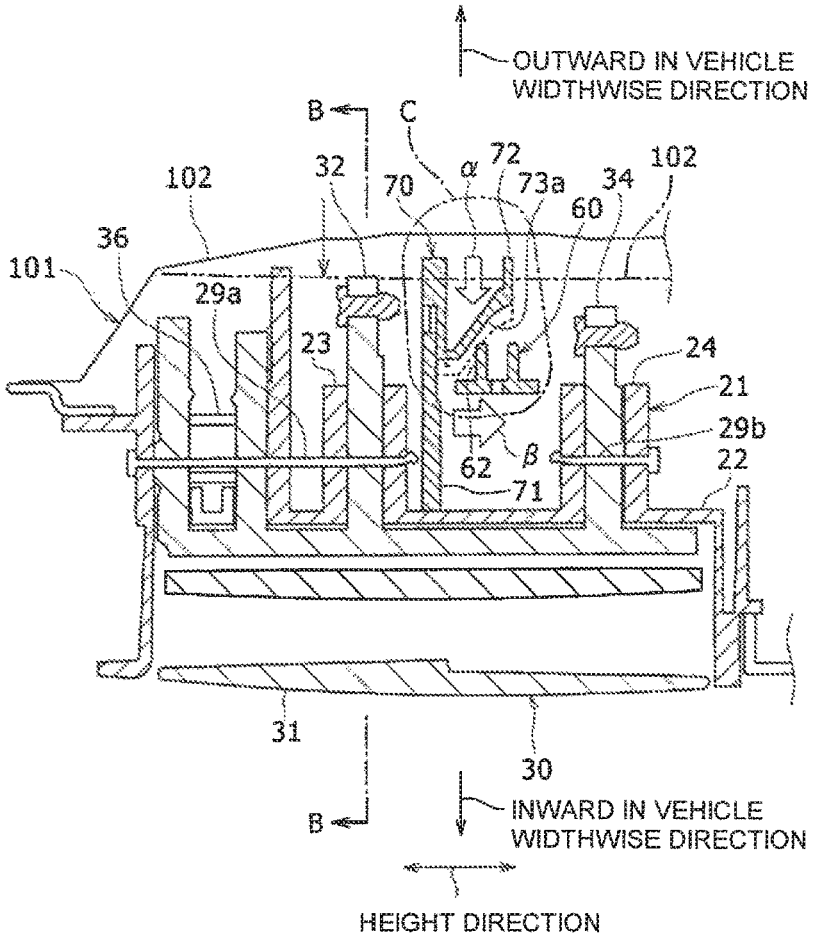
FIG. 3 is a sectional view taken along the line A-A in FIG. 2.
Figure 4:
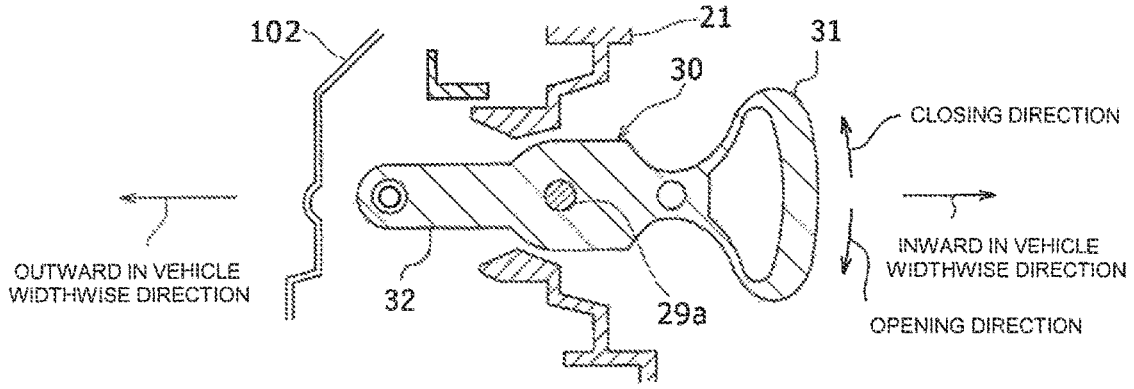
FIG. 4 is a sectional view taken along the line B-B in FIG. 3.

FIG. 2 is a perspective view showing the remote controller 20 a part of which is omitted. FIG. 3 is a sectional view taken along the line A-A in FIG. 2. FIG. 4 is a sectional view taken along the line B-B in FIG. 3.

The bracket 21 has a bracket body 22 formed, for example, of a metal plate, and is fixed, for example, to the inner panel 103 (FIG. 1) in the slide door 101. As shown in FIG. 3, the bracket body 22 has a plurality of tube like parts 23 and 24 protruding outward in the vehicle widthwise direction, and support pins 29*a* and 29*b* are fixed to the plurality of tube like parts 23 and 24 so as to penetrate the tube like parts in the vehicle height direction (right/left direction in FIG. 3).

The inner handle 30 is swingably supported on the front side of the bracket 21, and is disposed such that part of the inner handle is exposed in the vehicle compartment of the vehicle. Specifically, as shown in FIG. 4, the inner handle 30 has a handle body 31, and has first and second arm parts 32 and 34 (FIG. 3) protruding outward in the vehicle widthwise direction from the handle body 31.

The handle body 31 is molded into a substantially fan-like pillar shape extending in the vehicle height direction (front/back direction of the view plane of FIG. 4). A part of the handle body 31 is exposed in the vehicle compartment. The first and second arm parts 32 and 34 are disposed to be spaced apart in the vehicle height direction. The first and second arm parts 32 and 34 are inserted into the plurality of tube like parts 23 and 24 of the bracket body 22, and swingably supported around an axis along the vehicle height direction by the support pins 29*a* and 29*b*. In this state, the tips of the first and second arm parts 32 and 34 face the outer panel 102 of the slide door 101. The inner handle 30 is urged by a spring 36 (FIG. 2 and FIG. 3) so as to maintain its neutral position in the swing direction.

Figure 11:
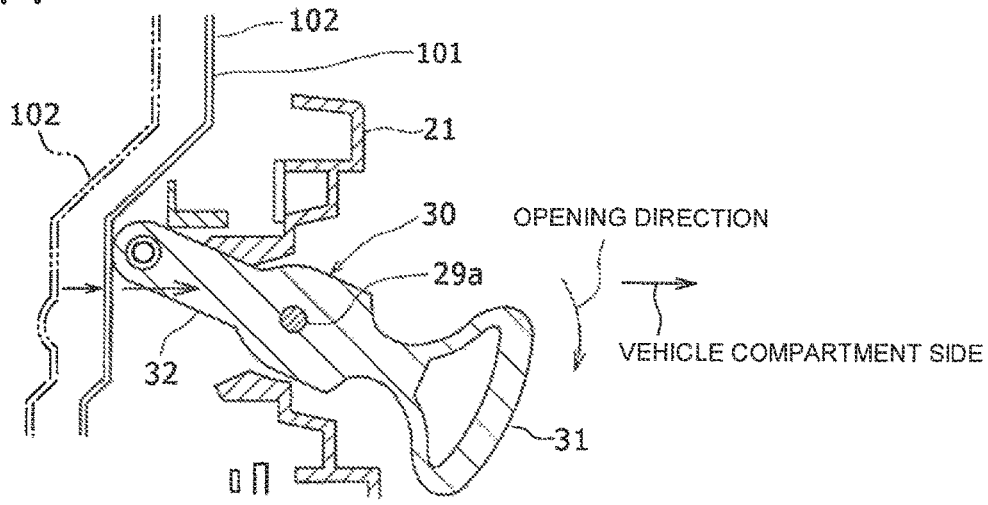
FIG. 11 is a view, corresponding to FIG. 4, showing a state where the inner handle is pushed by an outer panel of a slide door, in the embodiment according to the present disclosure.

The first arm part 32 swings in the opening direction such that its tip moves to the front side (obliquely upper side in FIG. 2; backside of the view plane of FIG. 3), and thereby transmits power to the front and rear lock parts 11 and 13. The second arm part 34 swings in the closing direction such that its tip moves to the rear side (obliquely lower side in FIG. 2; front side of the view plane of FIG. 3), and thereby transmits power to the full open lock part 15. The tip of the first arm part 32 is closer to the outer panel 102 than the tip of the second arm part 34. Therefore, when, upon vehicle side impact, load is exerted from the outside on the outer panel 102, which deforms to the vehicle compartment interior side, there is a possibility, as shown in FIG. 11 mentioned later, that the first arm part 32 will be pushed by the outer panel 102 and caused to be forcibly manipulated in the opening direction. If the first arm part 32 is manipulated as above and the manipulation force of the inner handle 30 is transmitted to the front and rear lock parts 11 and 13 via the lever operation mechanism 40 mentioned later, there is a possibility that the slide door 101 (FIG. 1) will be brought into the openable state and caused to open.

In order to prevent such a disadvantage, as mentioned later, the embodiment is configured such that the remote controller 20 includes the slider support mechanism 70 (FIG. 2). The slider support mechanism 70 has a guide plate part 71 contained in the bracket 21, and a slider 72 slidably supported on the guide plate part 71, and the slider 72 is disposed so as to face the child protect lever 60 (FIG. 2). Further, the slider 72 moves the child protect lever 60 in one direction such that the manipulation force of the inner handle 30 is not to be transmitted to front and rear release levers 50 and 51 when the slider 72 moves to the vehicle compartment side by being pushed by the outer panel 102 (FIG. 3).

The lever operation mechanism 40 is supported on the bracket 21, and has pivotable first lever 42 and second lever 43 (FIG. 5), and a rod 44 connecting the first lever 42 and the inner handle 30.

Figure 5:
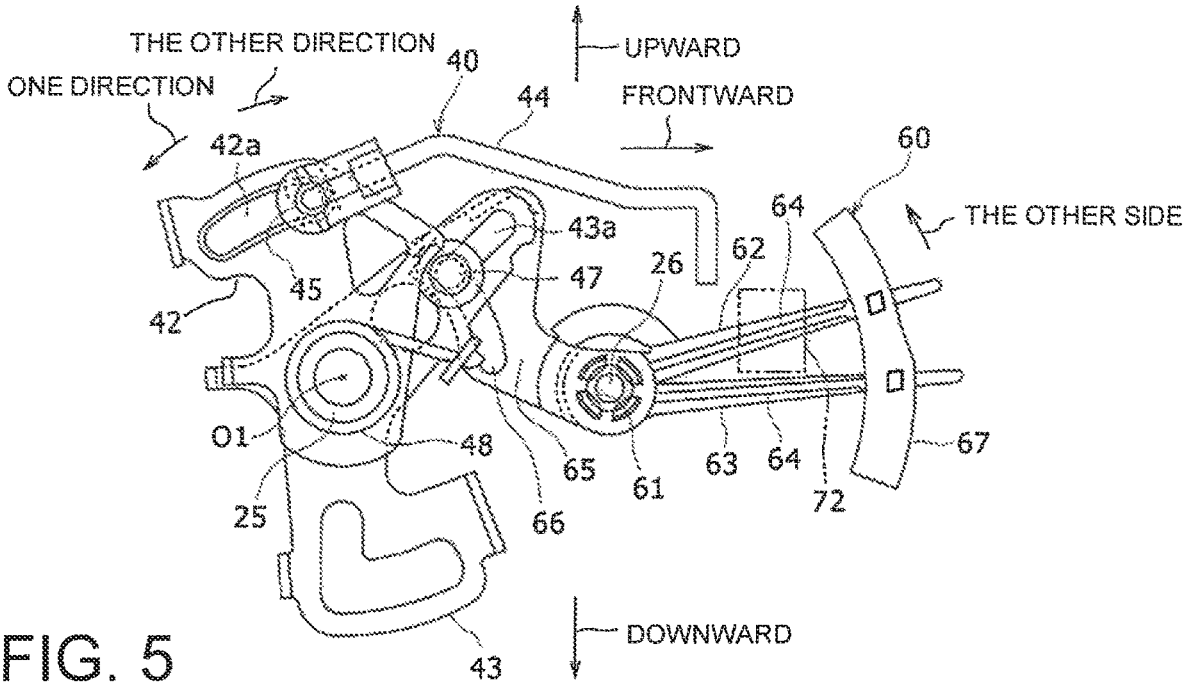
FIG. 5 is a view showing a state where a child protect lever is manipulated to another side, with the child protect lever and partial configurations of a lever operation mechanism being taken out of the remote controller shown in FIG. 2.
Figure 6:
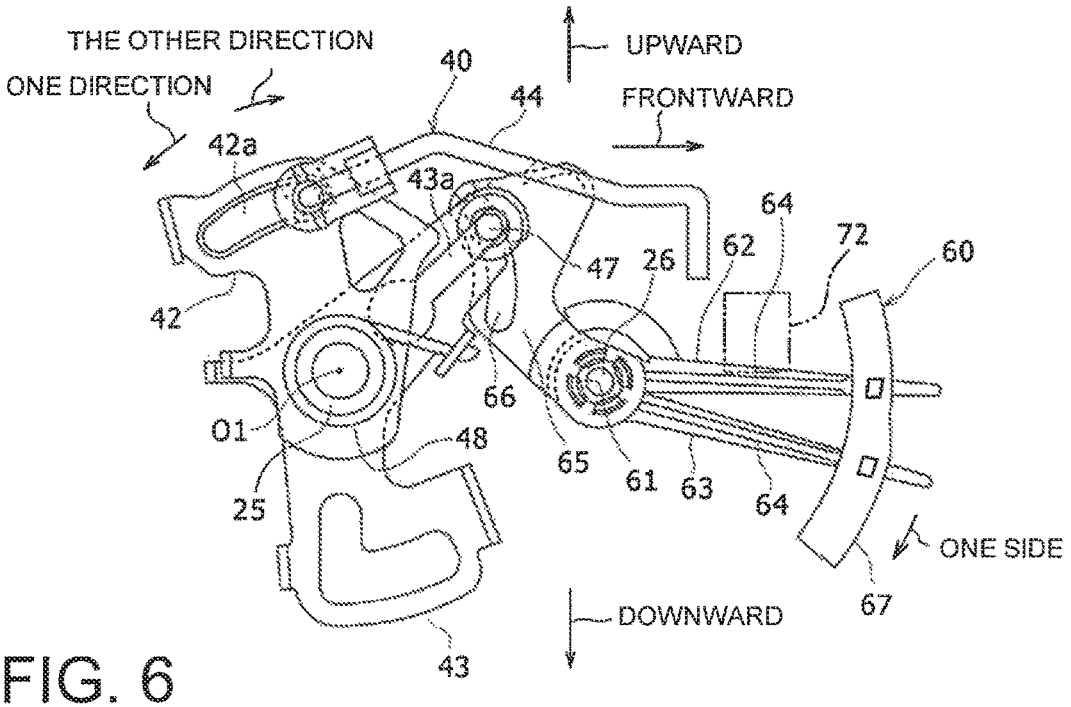
FIG. 6 is a view, corresponding to FIG. 5, showing a state where the child protect lever is manipulated to one side in which state an inner handle is not manipulated, in the embodiment according to the present disclosure.
Figure 7:
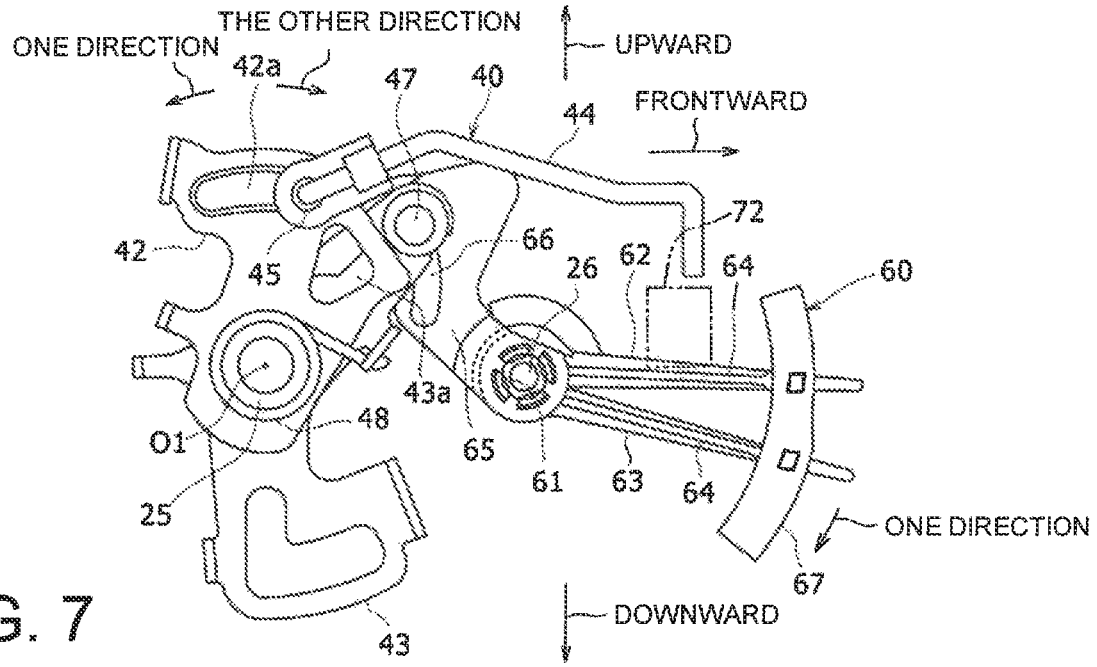
FIG. 7 is a view, corresponding to FIG. 5, showing a state where the child protect lever is manipulated to the one side in which state the inner handle is manipulated in the opening direction, in the embodiment according to the present disclosure.

FIG. 5 is a view showing a state where the child protect lever 60 is manipulated to the other side, and shows the child protect lever 60 and partial configurations of the lever operation mechanism 40 being taken out of the remote controller 20. FIG. 6 is a view, corresponding to FIG. 5, showing a state where the child protect lever 60 is manipulated to the one side in which state the inner handle 30 (FIG. 3 and FIG. 4) is not manipulated. FIG. 7 is a view, corresponding to FIG. 5, showing a state where the child protect lever 60 is manipulated to the one side in which state the inner handle 30 is manipulated in the opening direction.

The first lever 42 constituting the lever operation mechanism 40 has a long hole 42*a* formed on its upper side, and at its lower end part, is supported rotatably rearward of the inner handle 30 in the bracket 21 (FIG. 2). The long hole 42*a* is formed into an arc shape around a pivot axis O1 of the first lever 42. A slide pin 45 engaging with the long hole 42*a* of the first lever 42, and the tip part of the first arm part 32 (FIG. 2) of the inner handle 30 (FIG. 2), are connected with the rod 44. The first lever 42 is urged in one direction by a spring 46 (FIG. 2).

Meanwhile, the second lever 43 constituting the lever operation mechanism 40 has a long hole 43*a* on its upper side, and at its intermediate part, is supported rotatably around the pivot axis O1 of the first lever 42 relative to the bracket 21. The long hole 43*a* is formed in the radial direction of a circle around the pivot axis O1. When the child protect lever 60 mentioned later is located at the position where it is manipulated on the other side, a slide pin 47 engaging with the long hole 43*a* of the second lever 43 engages with the front edge part of the first lever 42. The second lever 43 is urged in the one direction by a spring 48 disposed around the pivot axis O1.

As to the first lever 42 and the second lever 43, a hole part formed at their intermediate position is fitted to a shaft part 25 fixed to the bracket 21 (FIG. 2), and the second lever 43 is overlapped with the backside of the first lever 42. The front release lever 50 (FIG. 2) and the rear release lever 51 (FIG. 2) are joined onto the backside of the second lever 43.

The front release lever 50 and the rear release lever 51 are supported on the bracket 21 rotatably around the pivot axis O1 (FIG. 5) of the first lever 42. A long hole 50*a* in an arc shape around the pivot axis O1 is formed on the upper side of the front release lever 50, and a slide pin (not shown) engages with the long hole 50*a*. One end of the cable W1 (FIG. 1) is joined to this slide pin, with the other end of the cable W1 being connected to the front lock part 11. The front release lever 50 and the rear release lever 51 are fitted to the shaft part 25 fixed to the bracket 21, and are overlapped with the backside of the second lever 43.

On the upper side of the rear release lever 51, a locking part 51*a* is formed at a position separate from the pivot axis O1. One end of the cable W2 (FIG. 1) is joined to the locking part 51*a*, with the other end of the cable W2 being connected to the rear lock part 13 in the state where the one end of the cable W2 is locked to the locking part 51*a*. Notably, in place of the long hole 50*a*, in the front release lever 50, a locking part may be formed at a position separate from the pivot axis O1 similarly to the rear release lever 51, and the one end of the cable W1 may be locked to this locking part, with the other end of the cable W1 being connected to the front lock part 11.

As shown in FIG. 5, when the child protect lever 60 mentioned later is manipulated on the other side and the inner handle 30 (FIG. 4) is manipulated in the opening direction which is on the one side, the first lever 42 is pulled frontward via the rod 44, and pivots in the other direction against the elastic force of the spring 46. Thereby, the second lever 43 is pushed by the first lever 42 via the slide pin 47, and the second lever 43, the front release lever 50 and the rear release lever 51 pivot in the other direction the same as for the first lever 42. Thereby, the cables W1 and W2 joined to the front release lever 50 and the rear release lever 51 are pulled, and, power for bringing the slide door 101 into the openable state is input to the front lock part 11 and the rear lock part 13. In this state, the front release lever 50 and the rear release lever 51 are operated relating to opening. The front lock part 11 and the rear lock part 13 engage with the corresponding strikers to maintain the slide door 101 in the closed state when the corresponding release levers 50 and 51 are not operated relating to opening. On the other hand, the engagements of the front lock part 11 and the rear lock part 13 with the corresponding strikers are released by the operating relating to opening of the corresponding release levers 50 and 51, to bring the slide door 101 into the openable state.

The child protect lever 60 invalidates manipulation of the inner handle 30 in the opening direction. Specifically, as shown in FIG. 2 and FIG. 5 to FIG. 7, the child protect lever 60 is formed into a substantial Y-shape as a whole, and has a shaft hole 61 formed in its intermediate part, two arm parts 62 and 63 extending into a V-shape frontward of the shaft hole 61, and a substantially chevron-shaped long hole formation part 65 formed rearward of the shaft hole 61. The tip parts of the two arm parts 62 and 63 are connected with an arc-shaped guide part 67. The arc-shaped guide part 67 is formed in the slide door 101 (FIG. 1), or its movement is guided along the arc direction of the arc-shaped guide part 67 with respect to a portion fixed to the slide door 101. In each of the arm parts 62 and 63, a plate part 64 extending in the longitudinal direction is formed to protrude on its face outward in the vehicle widthwise direction, the face outward being on the outer panel side (front side of the view plane of FIG. 5 to FIG. 7).

A shaft part 26 along the vehicle widthwise direction is fixed at a position downward of the inner handle 30 on the front side of the bracket 21, and the shaft part 26 is inserted into the shaft hole 61 of the child protect lever 60. Thereby, the child protect lever 60 is supported swingingly movably around the axis along the vehicle widthwise direction.

In the state where the remote controller 20 is disposed in the slide door 101, the tip parts of the arm parts 62 and 63 are exposed in the vehicle compartment. The child protect lever 60 swings in the upper/lower direction by manipulation where an occupant of the vehicle pushes down the tip part of the arm part 62, 63 to the one side inside the vehicle, and by manipulation of pushing it up to the other side.

As shown in FIG. 5 to FIG. 7, an arc-shaped long hole 66 is formed in the long hole formation part 65. As shown in FIG. 5, the long hole 66 is disposed along an arc around the pivot axis O1 of the first lever 42 in the state where the child protect lever 60 is manipulated on the other side so as to validate manipulation of the inner handle 30 (FIG. 4) in the opening direction. The slide pin 47 engaging with the long hole 43*a* of the second lever 43 engages with the long hole 66.

When the child protect lever 60 is manipulated so as to move to the other side, as above, the long hole 66 of the long hole formation part 65 comes close to the pivot axis O1 of the first lever 42. Thereby, the slide pin 47 engages with the front end edge of the first lever 42. In this case, when the inner handle 30 (FIG. 4) is manipulated in the opening direction in the state of closing the slide door 101 (FIG. 1), since the rod 44 joined to the first arm part 32 (FIG. 2) moves frontward, the first lever 42 pivots in the other direction. Thereby, the second lever 43 also pivots in the other direction similarly to the first lever 42. Therefore, the front and rear release levers 50 and 51 (FIG. 2) joined to the second lever 43 also pivot in the other direction and are caused to operate relating to opening, and power is input to the front lock part 11 and the rear lock part 13 via the cables W1 and W2 (FIG. 1). Accordingly, the slide door 101 is brought into the openable state.

On the other hand, as shown in FIG. 6, when the child protect lever 60 is manipulated so as to move to the one side in order to invalidate manipulation of the inner handle 30 (FIG. 4) in the opening direction, the long hole 66 of the long hole formation part 65 goes away from the pivot axis O1 of the first lever 42. Thereby, the slide pin 47 engaging with the second lever 43 moves to a position where it cannot engage with the front end edge of the first lever 42. In this state, when the inner handle 30 (FIG. 4) is manipulated in the opening direction in the state of closing the slide door 101 (FIG. 1), as shown in FIG. 7, the rod 44 moves frontward, and the first lever 42 pivots in the other direction. In this case, the second lever 43 is not pushed in the other direction by the first lever 42. Therefore, the second lever 43 does not pivot in the other direction. Thereby, the front and rear release levers 50 and 51 (FIG. 2) are not caused to operate relating to opening, and power is not input to the front lock part 11 (FIG. 1) and the rear lock part 13 (FIG. 1) from the front and rear release levers 50 and 51. Therefore, the front lock part 11 and the rear lock part 13 hold the slide door 101 in the closed state. Accordingly, as shown in FIG. 6 and FIG. 7, the child protect lever 60, by its movement to the one side, makes manipulation force of the inner handle 30 not be transmitted to the front and rear release levers 50 and 51.

Returning to FIG. 2, the lever operation mechanism 40 includes a pivotable full open lever 52, and a rod 53 connecting the full open lever 52 and the inner handle 30. The full open lever 52 is supported on the bracket 21 pivotably around the pivot axis of the first lever 42. A long hole 52*a* is formed on the lower side of the full open lever 52, and the rod 53 connects a slide pin (not shown) engaging with the long hole 52*a*, and the tip part of the second arm part 34 of the inner handle 30. The full open lever 52 is fitted to the shaft part 25 fixed to the bracket 21, and is overlapped with the front side of the first lever 42. The full open lever 52 is urged in the one direction by a spring 54.

When the inner handle 30 (FIG. 4) is manipulated in the closing direction which is on the other side, via the rod 53 (FIG. 2), the full open lever 52 pivots in the other direction against the elastic force of the spring 54. Thereby, the cable W3 (FIG. 1) joined to the upper side of the full open lever 52 is pulled, and power for bringing the slide door 101 into the closable state from the state of keeping the door full open is input to the full open lock part 15 (FIG. 1). Therefore, the engagement of the full open lock part 15 with the corresponding striker is released to bring the slide door 101 into the closable state.

Moreover, the vehicle slide door apparatus 10 includes an outer handle (not shown) supported on the slide door 101 such that its part is exposed outward in the vehicle widthwise direction. Also with this outer handle, power can be input to the lock parts 11, 13 and 15 via the lever operation mechanism 40.

Figure 8:
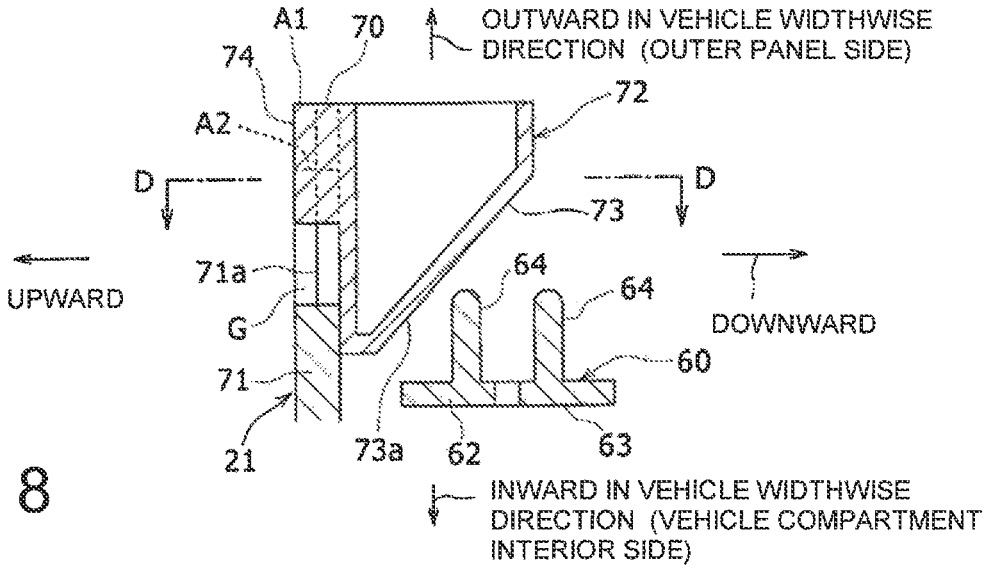
FIG. 8 is an expanded view of the portion C in FIG. 3.
Figure 9:
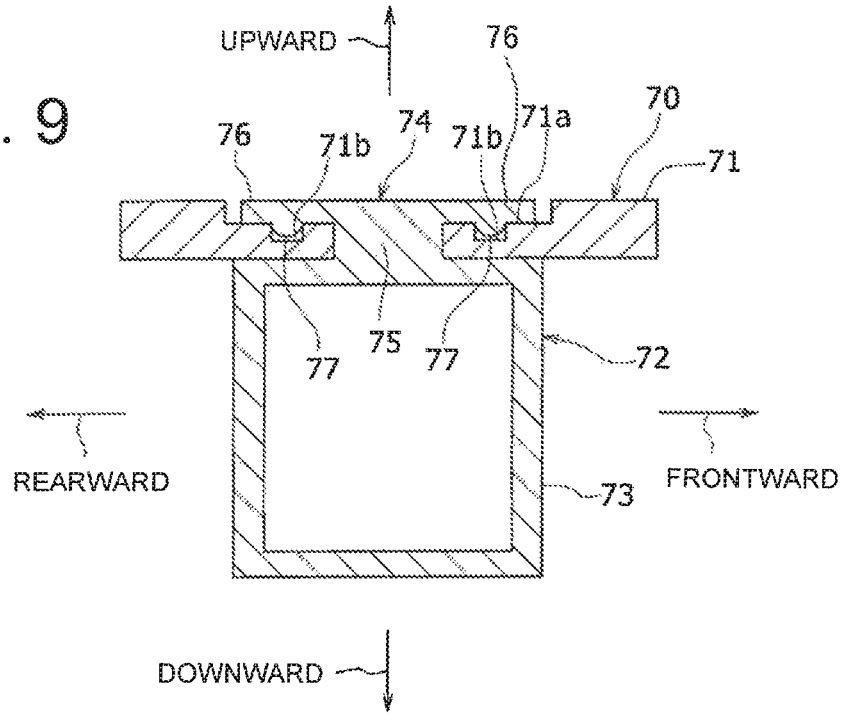
FIG. 9 is a sectional view taken along the line D-D in FIG. 8.
Figure 10:
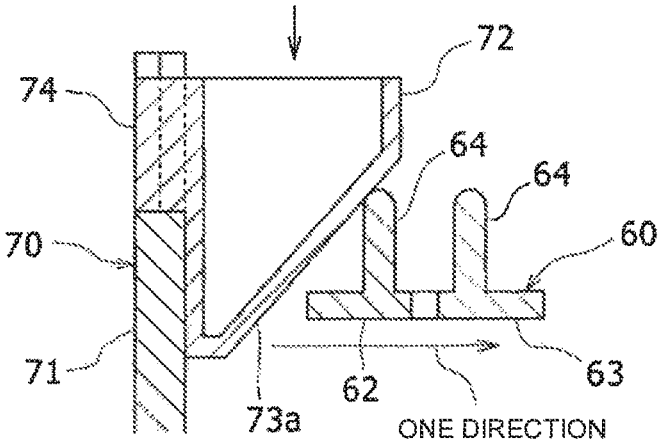
FIG. 10 is a view, corresponding to FIG. 8, showing a state where a slider is pushed to the vehicle compartment interior side, in the embodiment according to the present disclosure.

Next, the slider support mechanism 70 will be described in detail. FIG. 8 is an expanded view of the portion C in FIG. 3. FIG. 9 is a sectional view taken along the line D-D in FIG. 8. FIG. 10 is a view, corresponding to FIG. 8, showing a state where the slider 72 is pushed to the vehicle compartment interior side.

The slider 72 is supported, in the bracket 21, on the outer panel side of the slide door 101 (FIG. 1) so as to be slidable to the vehicle compartment interior side which is the opposite side relative to the outer panel. Specifically, as shown in FIG. 2, FIG. 3, FIG. 8 and FIG. 9, the bracket 21 includes, in the bracket body 22, a guide plate part 71 fixed to its surface on the outer panel 102 side. The guide plate part 71 is fixed so as to protrude from the bracket body 22 in the vehicle widthwise direction (upper/lower direction in FIG. 3). The guide plate part 71 is formed of metal or resin.

As shown in FIG. 8 and FIG. 9, a guide groove 71*a* extending in the vehicle widthwise direction (upper/lower direction in FIG. 8; front/back direction of the view plane of FIG. 9), is formed in an intermediate part at the tip of the guide plate part 71 in the front/rear direction (front/back direction of the view plane of FIG. 8; right/left direction in FIG. 9). As shown in FIG. 9, the guide groove 71*a* has a T-shape as a shape seen from the outside in the vehicle widthwise direction. Moreover, two rectangular or circular hole parts 71*b* are formed in portions close to the outer end of the guide groove 71*a* in the vehicle widthwise direction, these portions being close to both ends of the guide groove 71*a* in the front/rear direction.

The slider 72 includes: a bottomed tube like body part 73 which is formed of resin or metal and has a shape that is rectangular as seen from the outside in the vehicle widthwise direction; and a slide projection 74 connected to the body part 73. The body part 73 has an inclined face 73*a* at its inward end in the vehicle widthwise direction. The inclined face 73*a* is inclined relative to the vehicle widthwise direction so as to become closer to the guide plate part 71 as it goes further inward in the vehicle widthwise direction.

The slide projection 74 includes: a square pillar-shaped pillar part 75 protruding from an vehicle widthwise directional outer half portion of the outer peripheral surface of the body part 73, at the intermediate part on the surface on the side of the guide plate part 71 in the front/rear direction; and a flat plate-like plate part 76 perpendicularly connected to the pillar part 75, and cross-sectional shape of the slide projection 74 is a substantial T-shape. Semispherical ribs 77 are formed at two positions facing the hole parts 71*b* of the guide groove 71*a*, these two positions being located close to both ends of the plate part 76 in the front/rear direction. The ribs 77 may be circular pillar-shaped or square pillar-shaped.

The slide projection 74 is inserted into the guide groove 71*a*, of the guide plate part 71, having a T-shaped cross section from the outside in the vehicle widthwise direction, and the portions close to both ends of the plate part 76 of the slide projection 74 and the surface of the body part 73 on the side of the guide plate part 71 face both lateral surfaces of the guide plate part 71 without hardly any gaps. Moreover, the ribs 77 of the slide projection 74 engage with the hole parts 71*b* of the guide groove 71*a*. Thereby, the slider 72 is supported on the guide plate part 71. As shown in FIG. 8, in this state, a space G is formed between the vehicle widthwise directional inner end of the slide projection 74 and the bottom face of the guide groove 71*a*. Therefore, the slider 72 is supported on the guide plate part 71 so as to be slidable to the vehicle compartment interior side which is the opposite side relative to the outer panel in the vehicle widthwise direction. In this state, a vehicle widthwise directional outer end A1 (FIG. 8) of the slider 72 is positioned outward of a vehicle widthwise directional outer end A2 (FIG. 8) of the guide plate part 71 in the vehicle widthwise direction.

Furthermore, in the state where the child protect lever 60 has moved to the other side as shown in FIG. 5, as shown in FIG. 3 and FIG. 8, the inclined face 73*a* of the slider 72 faces, with a gap, the tip of the plate part 64 that is on one arm part 62, of the two arm parts 62 and 63, of the child protect lever 60, in the direction of the outside in the vehicle widthwise direction. When the slider 72 is pushed to the vehicle compartment interior side, the engagements of the ribs 77 of the slider 72 with the hole parts 71*b* of the guide plate part 71 are released, and as shown in FIG. 10, the slider 72 moves to the vehicle compartment side along the guide groove 71*a* and strikes against the bottom face of the guide groove 71*a*. In this case, the slider 72 pushes the one arm part 62 of the child protect lever 60 with the inclined face 73*a* so as to move it to the one side.

When the child protect lever 60 has moved to the one side, as mentioned above, manipulation force of the inner handle 30 (FIG. 2 to FIG. 4) is not transmitted to the front and rear release levers 50 and 51.

According to the aforementioned vehicle slide door apparatus, upon vehicle side impact in the state where the slide door 101 is closed, the slider 72 can be moved to the vehicle compartment interior side when the slide door 101 is pushed to the vehicle compartment side. Thereby, since the child protect lever 60 can be moved in the one direction so as to make manipulation force of the inner handle 30 not be transmitted to the front and rear release levers 50 and 51, the slide door 101 can be prohibited from opening.

For example, as shown in FIG. 11, there is a possibility that upon vehicle side impact, the outer panel 102 of the slide door 101 will deform to the vehicle compartment interior side to collide with the tip of the first arm part 32 of the inner handle 30, and the inner handle 30 will be forcibly manipulated in the opening direction. In this case, according to the embodiment, the outer panel 102 moves from the position of the solid line in FIG. 3 to the position of the long dashed double-short dashed line therein, and strikes against the slider 72 earlier than the first arm part 32. Then, since the slider 72 is pushed to move to the vehicle compartment interior side, the child protect lever 60 is pushed by the inclined face 73*a* to move in the one direction (β-direction of an arrow in FIG. 3). Thereby, even when the inner handle 30 is pushed by the outer panel 102 to be manipulated in the opening direction, the manipulation force is not transmitted to the front and rear release levers 50 and 51 (FIG. 2). Therefore, the slide door 101 can be prohibited from opening.

Moreover, the slider 72 has the inclined face 73*a*, the inclined face 73*a* faces the child protect lever 60, and when the slider 72 is pushed to the vehicle compartment interior side, the slider 72 pushes the child protect lever 60 with the inclined face 73*a* so as to move it to the one side. Thereby, upon vehicle side impact, the child protect lever 60 can be more smoothly moved in the one direction by the movement of the slider 72.

Notably, although there is a possibility that, upon vehicle side impact, the outer panel 102 will collide with the tip of the second arm part 34 (FIG. 3) of the inner handle 30, and the inner handle 30 forcibly manipulated in the closing direction, the slide door 101 will have been closed at that time. In this case, although power is input to the full open lock part 15 (FIG. 1) by the inner handle 30 manipulated in the closing direction, the full open lock part 15 does not engage with the lower striker when the door is closed. Therefore, the slide door 101 will not open as a result of the outer panel 102 colliding with the second arm part 34.

Figure 12:
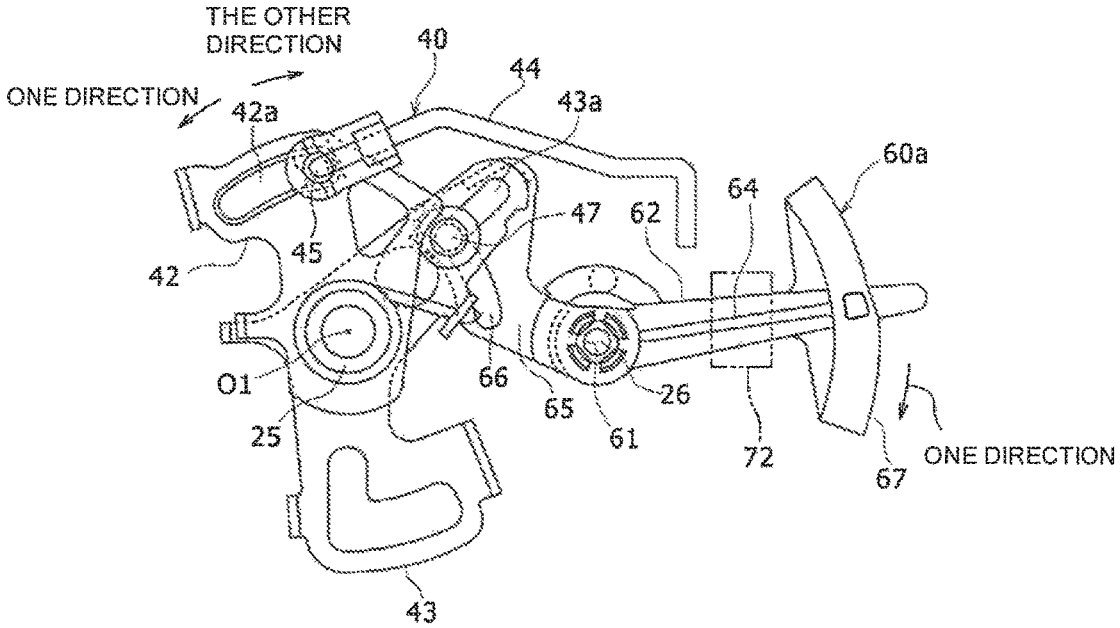
FIG. 12 is a view, corresponding to FIG. 5, showing a vehicle slide door apparatus of another example of the embodiment.

FIG. 12 is a view, corresponding to FIG. 5, showing a vehicle slide door apparatus of another example of the embodiment. In the configuration of this example, a child protect lever 60*a* has only one arm part 62. The arc-shaped guide part 67 is joined to the tip part of the arm part 62. The plate part 64 is formed on the face of the arm part 62 on the outer panel side (front side of the view plane of FIG. 12). The plate part 64 faces the inclined face of the slider 72 movably supported in the vehicle widthwise direction relative to the bracket 21 (FIG. 2 and the like). Also with this configuration, similarly to the aforementioned configuration shown in FIG. 1 to FIG. 11, when, upon vehicle side impact, the slide door is pushed to the vehicle compartment side, the slide door can be prohibited from opening, by the slider 72 moving the child protect lever 60 to the one side. Other configurations and operation for this example are similar to those for the configuration in FIG. 1 to FIG. 11.

Notably, the shapes of the slider and the child protect lever are not limited to those for each of the aforementioned configurations. For example, in place of the inclined face 73*a* (FIG. 8) of the slider 72, a curved part which has an arc-shaped cross section and protrudes to the child protect lever 60, 60*a* side may be formed. In addition to this, or in place of this, in place of the plate part(s) 64 (FIG. 8 and the like), a curved part which has an arc-shaped cross section and protrudes to the slider 72 side may be formed, on the arm part(s) of the child protect lever 60, 60*a* on the slider side.

The invention claimed is:

1. A vehicle slide door apparatus comprising:

a bracket fixed in a slide door;

a lever operation mechanism supported on the bracket, and causing a release lever connected to a door lock part to perform an opening operation in accordance with manipulation of an inner handle in an opening direction, the door lock part holding the slide door in a closed state when the release lever does not perform the opening operation, the door lock part bringing the slide door into an openable state upon the opening operation of the release lever;

a child protect lever swingingly movably supported on the bracket, the child protect lever, by moving to one side in a swinging direction, preventing a manipulation force of the inner handle from being transmitted to the release lever; and a slider supported in the bracket, the slider facing an outer panel of the slide door, the slider being slidable toward a vehicle compartment interior side, which is an inward direction in a vehicle widthwise direction, and when being pushed toward the vehicle compartment interior side while the slide door is closed, the slider moving the child protect lever to the one side in the swinging direction, wherein the child protect lever includes a user-touchable portion that is configured to be touched by an occupant of the vehicle to swingingly move the child protect lever between (i) the one side in the swinging direction to prevent the manipulation force of the inner handle from being transmitted to the release lever, and (ii) an other side in the swinging direction to not prevent the manipulation force of the inner handle from being transmitted to the release lever, and the slider is a separate element from the user-touchable portion of the child protect lever, and the slider moves in a direction different from a direction in which the user-touchable portion is moved to move the child protect lever between the one side and the other side in the swinging direction.

2. The vehicle slide door apparatus according to claim 1, wherein the slider is pushed toward the vehicle compartment interior side, to move the child protect lever to the one side in the swinging direction, only when the slide door is subjected to a vehicle side impact to the outer panel.

3. A vehicle slide door apparatus comprising:

a bracket fixed in a slide door;

a lever operation mechanism supported on the bracket, and causing a release lever connected to a door lock part to perform an opening operation in accordance with manipulation of an inner handle in an opening direction, the door lock part holding the slide door in a closed state when the release lever does not perform the opening operation, the door lock part bringing the slide door into an openable state upon the opening operation of the release lever;

a child protect lever swingingly movably supported on the bracket, the child protect lever, by moving to one side in a swinging direction, preventing a manipulation force of the inner handle from being transmitted to the release lever; and a slider supported in the bracket, the slider facing an outer panel of the slide door, the slider being slidable toward a vehicle compartment interior side, which is an inward direction in a vehicle widthwise direction, and when being pushed toward the vehicle compartment interior side while the slide door is closed, the slider moving the child protect lever to the one side in the swinging direction, wherein the child protect lever includes a user-touchable portion that is configured to be touched by an occupant of the vehicle to swingingly move the child protect lever between (i) the one side in the swinging direction to prevent the manipulation force of the inner handle from being transmitted to the release lever, and (ii) an other side in the swinging direction to not prevent the manipulation force of the inner handle from being transmitted to the release lever, the slider is a separate element from the user-touchable portion of the child protect lever, and the slider is pushed toward the vehicle compartment interior side, to move the child protect lever to the one side in the swinging direction, only when the slide door is subjected to a vehicle side impact to the outer panel.

* * * * *